US005474296A

United States Patent [19]

Schmidt et al.

[11] Patent Number: 5,474,296

[45] **Date of Patent: * Dec. 12, 1995**

[54] METAL WOOD GOLF CLUB WITH VARIABLE FACEPLATE THICKNESS

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Jun. 7, 2011, has been disclaimed.

[21] Appl. No.: 251,176

[22] Filed: May 31, 1994

Related U.S. Application Data

[63] Continuation of Ser. No. 969,975, Nov. 2, 1992, Pat. No. 5,318,300, which is a continuation-in-part of Ser. No. 595, 963, Oct. 16, 1990, Pat. No. 5,067,715.

[51] Int. Cl.[6] ..... A63B 53/04

[52] U.S. Cl. ..... 273/167 J; 273/167 H; 273/169

[58] Field of Search ..... 273/167 R, 167 F–167 H, 273/173, 169, 78, 167 A–167 E, 167 J–172, 175

[56] References Cited

U.S. PATENT DOCUMENTS

| | | | |
|---|---|---|---|
| D. 225,419 | 12/1972 | Mills . | |
| D. 277,221 | 1/1985 | Kobayashi . | |
| 1,485,685 | 3/1924 | McMahon . | |
| 1,555,425 | 9/1925 | McKenzie . | |
| 1,658,581 | 2/1928 | Tobia . | |
| 1,671,956 | 5/1928 | Sime . | |
| 1,868,286 | 7/1932 | Grieve . | |
| 1,968,626 | 7/1934 | Young . | |
| 2,020,048 | 11/1935 | Cook et al. . | |
| 2,041,676 | 5/1936 | Gallagher . | |
| 2,083,189 | 6/1937 | Crooker . | |
| 2,087,685 | 7/1937 | Hackney . | |
| 2,458,920 | 1/1949 | Wheeler et al. . | |
| 2,460,435 | 2/1949 | Schaffer . | |
| 3,068,011 | 12/1962 | Sano . | |
| 3,625,518 | 12/1971 | Solheim . | |
| 3,640,534 | 2/1972 | Mills . | |
| 3,761,095 | 9/1973 | Thompson . | |
| 3,810,621 | 5/1974 | Mills . | |
| 3,819,181 | 6/1974 | Mills . | |
| 3,858,886 | 1/1975 | Cosby . | |
| 4,214,754 | 7/1980 | Zebelean . | |
| 4,252,262 | 2/1982 | Igarashi . | |
| 4,313,607 | 2/1982 | Thompson . | |
| 4,319,752 | 3/1982 | Thompson . | |
| 4,417,731 | 11/1983 | Yamada . | |
| 4,429,879 | 2/1984 | Schmidt . | |
| 4,432,549 | 2/1984 | Zebelean . | |
| 4,438,931 | 3/1984 | Motomiya . | |
| 4,511,145 | 4/1985 | Schmidt . | |
| 4,645,207 | 2/1987 | Teramoto et al. | 273/169 |
| 4,681,321 | 7/1987 | Chen et al. . | |
| 4,756,534 | 7/1988 | Thompson . | |
| 4,872,685 | 10/1989 | Sun . | |
| 4,920,781 | 6/1990 | Allen . | |
| 4,957,294 | 9/1990 | Long . | |
| 4,986,541 | 1/1991 | Teramoto et al. . | |
| 5,000,454 | 3/1991 | Soda . | |
| 5,014,993 | 5/1991 | Autonious | 273/169 |

(List continued on next page.)

FOREIGN PATENT DOCUMENTS

| | | | |
|---|---|---|---|
| 26072 | 9/1912 | United Kingdom . | |
| 160030 | 3/1921 | United Kingdom . | |
| 420332 | 11/1934 | United Kingdom . | |
| 1476889 | 5/1975 | United Kingdom . | |
| 2100993 | 1/1983 | United Kingdom . | |
| 2225726 | 6/1990 | United Kingdom . | |
| 2225725 | 6/1990 | United Kingdom | 273/167 H |
| 2230459 | 10/1990 | United Kingdom . | |

*Primary Examiner*—V. Millin
*Assistant Examiner*—Steven B. Wong
*Attorney, Agent, or Firm*—William W. Haefliger

[57] ABSTRACT

A metallic, golf club head having a hollow interior, comprising a ball-striking front wall and the head having walls at the top, bottom, rear, heel and toe of the head; the front wall having variable thickness.

36 Claims, 7 Drawing Sheets

U.S. PATENT DOCUMENTS 5,026,056 6/1991 McNally et al. ..... 273/167 F
5,028,049 7/1991 McKeighen .
5,042,806 8/1991 Helmstetter .
5,056,788 10/1991 Katayama ..... 273/167 F
5,067,715 11/1991 Schmidt et al. .
5,163,682 11/1992 Schmidt et al. .
5,318,300 6/1994 Schmidt et al. ..... 273/167 H

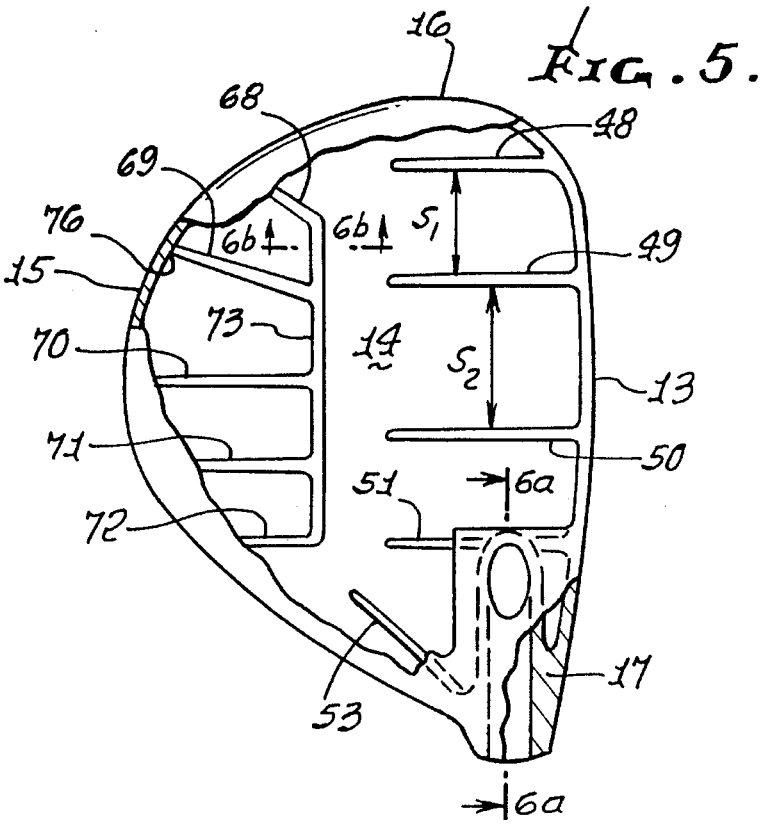
FIG. 5.
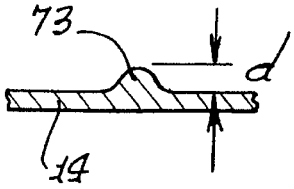
FIG. 6b.
FIG. 6.
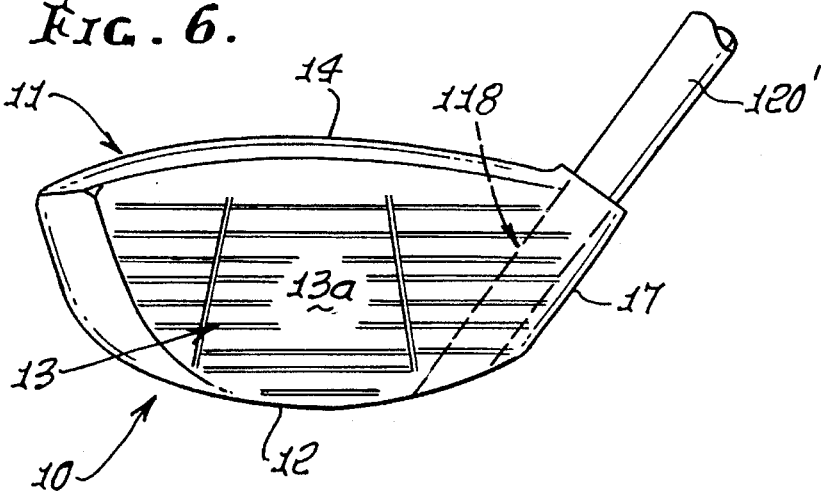
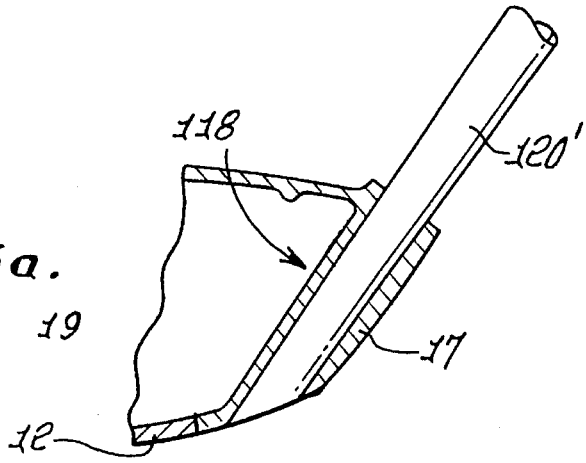
FIG. 6a.

.118
200
201
254
A $t_1$
.113
W
+1

.108
+2

.103
200
+3

.098
+4

.093
W
+5

.085
200
+6

$t_2$
.113
-1

.108
-2

.103
-3

.098
-4

.093
-5

.085
-6

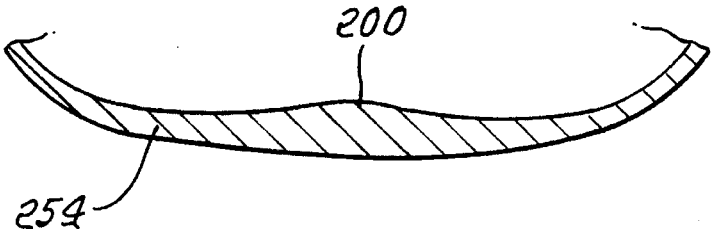
FIG. 14.
FIG. 15.
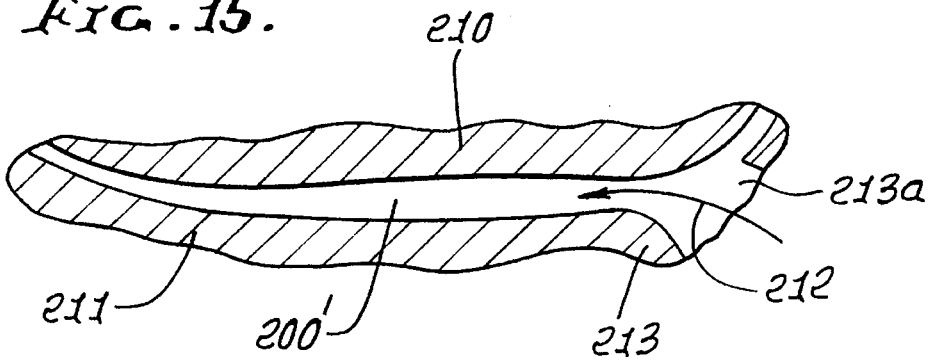
FIG. 16.
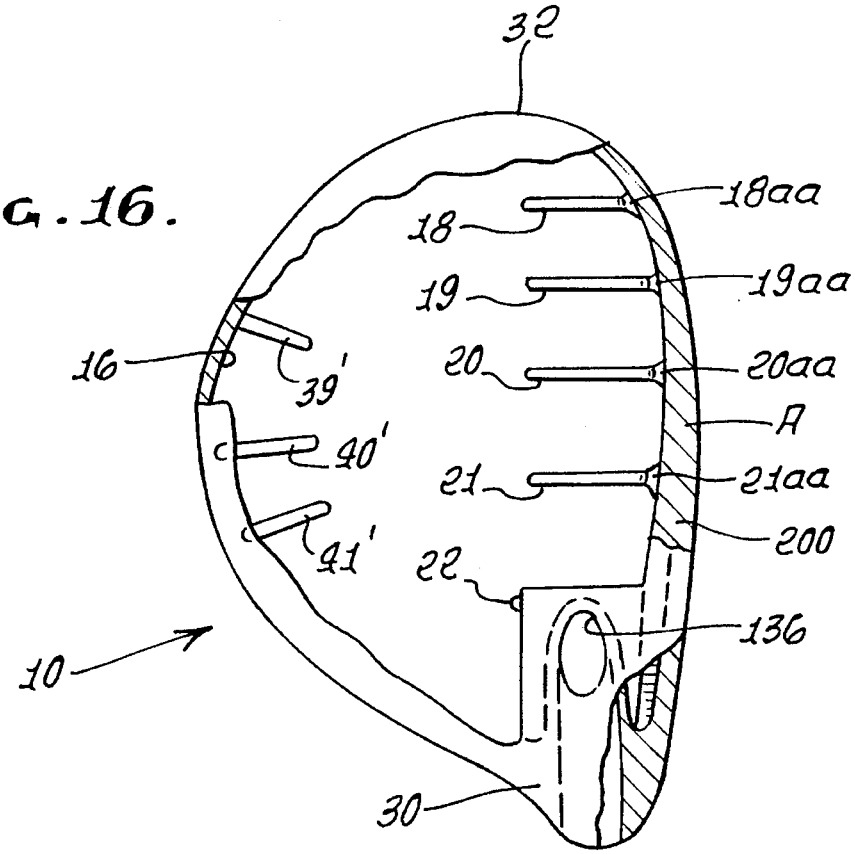

METAL WOOD GOLF CLUB WITH VARIABLE FACEPLATE THICKNESS

This is a continuation of application Ser. No. 07/969,975, filed Nov. 2, 1992 now U.S. Pat. No. 5,318,300, which application is a continuation-in-part of Ser. No. 595,963 filed Oct. 16, 1990 now U.S. Pat. No. 5,067,715.

BACKGROUND OF THE INVENTION

This invention relates generally to metal wood golf clubs, and more particularly to methods of casting head metal and resulting head configuration, with the objective of facilitating liquid metal flow to thin walls of the head.

At the present time, it has become desirable to provide larger metal wood heads containing the same or approximately the same amount of metal as prior smaller metal wood heads, due to need to facilitate ease and accuracy of ball striking, while at the same time complying with head weight limitations imposed by existent standards. Larger heads using the same amount of metal dictate need for shell wall regions of lesser thickness. This in turn increases the difficulty of successfully casting the head, since metal flow into thinner mold spaces is impeded, as for example by excessive cooling and from interruption or slowing before the metal can penetrate fully into all regions of the mold cavity. Also, reduced wall thickness tends to weaken the walls, leading to buckling or other failure modes during repeated use of the head in striking a golf ball, at high speed. There is need for means and methods of casting head metal which will alleviate these and other problems encountered in head shell configuration and casting.

Further, there is need for concentration of as much of the mass of the head as possible into the face of the club head and the portion of the head directly behind the face. This puts the mass of the head where it effectively contributes to the energy imparted to the ball, and also increases the strength of the head front wall.

In addition, very thin-walled, metal golf club heads present the problems of cracking and buckling of metal walls, and excessive front wall deflection, during ball impact. There is need to alter the manner in which shock waves are distributed within metal wood walls, as by providing a mechanism which guides, interrupts, spreads, or otherwise alters the shock waves which emanate from the face at impact, but while maintaining optimum wall thicknesses.

SUMMARY THE INVENTION

It is a major object of the invention to meet the above needs, as well as to overcome the problems and difficulties referred to. In accordance with the invention, a metallic golf club head comprises:

a) a ball-striking upright front wall, and the head also having walls at the top, bottom, rear, heel, and toe of the head, b) the front wall having variable thickness, between heel and toe regions, to resist cracking and buckling, and/or to efficiently transmit impact forces to the head top wall.

As will be seen, the head front wall variable thickness is measured in vertical planes normal to the front wall and spaced apart between the toe and heel; and said variable thickness may locally decrease in a direction toward the heel, or a direction toward the toe, or both. Such variable thickness may advantageously exist at locations proximate a merging interconnection of the front wall and the top wall, whereby cracking or buckling of the head at such locations due to force concentration is prevented.

A further object is to provide:

c) a first group of narrow, metallic, shock wave distributing dendrites extending from the variable thickness front wall generally rearwardly adjacent the underside of the top wall and integral therewith, d) the dendrites spaced apart by amounts greater than their widths, the maximum height dimensions of the dendrites below the underside of the top wall being between 0.050 inches and 0.100 inches and the dendrites being generally downwardly convex in cross-section.

As will be seen, a metallic hosel may be integrated into the head to strengthen the head and front wall; and the dendrites, metallic hosel within the head interior, and the variable thickness front wall all comprise parts of a single metallic casting.

Yet another object is to provide a variable thickness front wall in combination with head wall structure strengthened by dendrites, particularly narrow metallic dendrites which are integral with the rear wall and extend downwardly at the inner side of the rear wall.

A further object is to provide a variable thickness front wall in combination with a second group of narrow dendrites that extend beneath the top wall and are spaced apart in a transverse direction, the maximum height dimensions of the second group dendrites being between 0.050 and 0.100 inches.

A still further object is to provide a variable thickness front wall characterized by a locally rearwardly thickened portion which extends in a direction from a mid-region of the front wall toward a peripheral region of the front wall near the heel.

Typically, the thickened portion projects into the hollow interior of the head; and the thickened portion has an upright width which progressively increases in the heelward direction. Further, the thickened portion is generally rearwardly dome-shaped, in upright planes which extend rearwardly; and the front wall has decreasing thickness in a direction from the mid-region toward the toe, as well as from the mid-region toward the heel. In this regard, the locally thickened portion may have fan-shaped divergence between the mid-region of the front wall and the heel of the head, at the rear side of the front wall.

It is another object to provide an improved head incorporating the above, in relation to a hosel integrated into the head interior, and such club head having:

a) a substantially continuous hollow, metallic tube extending lengthwise along a shell wall from the shell top portion to the shell bottom portion, the tube being integral with and terminating proximate the metal shell top portion and having a bore, b) the tube bore receiving the shaft throughout a major length of the tube, the first end of the shaft being configured to extend into proximity with the bottom surface of the shell bottom portion, c) the shaft periphery connected to the tube bore, and the tube bore having an upper end terminating proximate the shell top portion, d) the tube having a lengthwise extending wall integrated along its length with the shell wall so that the shell supports the tube along its length, and whereby metal otherwise required for the tube is instead used in the shell at locations between the tube and the toe portion, to enhance the club head size, e) and the head front wall having variable thickness, as referred to.

In its method aspect, the invention includes supplying fluid metal (during head casting) via a zone defined by that locally thickened portion, to form head walls including the front wall, the metal cooling in situ at the walls. In thus flowing to the front wall mid-region via the fan-shaped mold cavity (corresponding to the fan-shape of the resultant locally thickened portion of the head front wall), the metal sustains minimum cooling, and is thus able to penetrate with greater flowability to remote wall regions of reduced thickness.

These and other objects and advantages of the invention, as well as the details of an illustrative embodiment, will be more fully understood from the following specification and drawings, in which:

DRAWING DESCRIPTION

Figure 1:
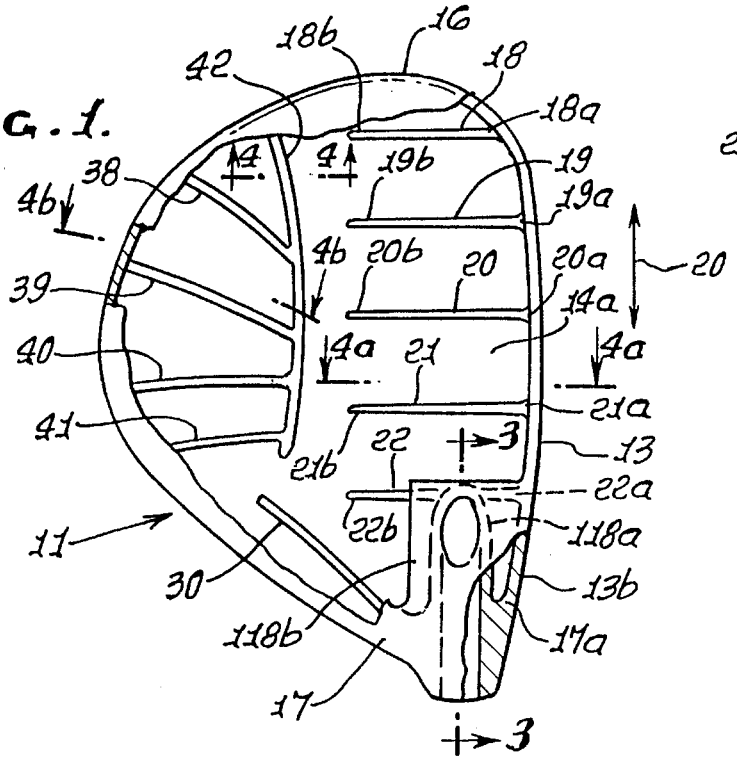
FIG. 1 is a plan view looking upwardly into a hollow metal wood head.
Figure 4A:
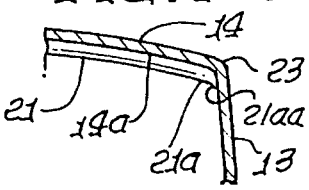
FIG. 4 is an enlarged fragmentary section taken on lines 4—4 of FIG. 1.
Figure 4:
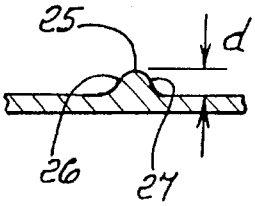
Figure 2:
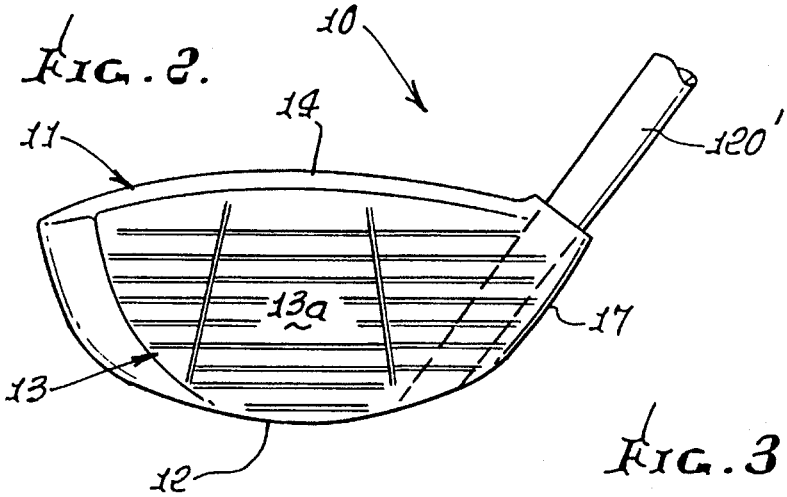
FIG. 2 is an elevation looking toward the front face of the FIG. 1 head.
Figure 3:
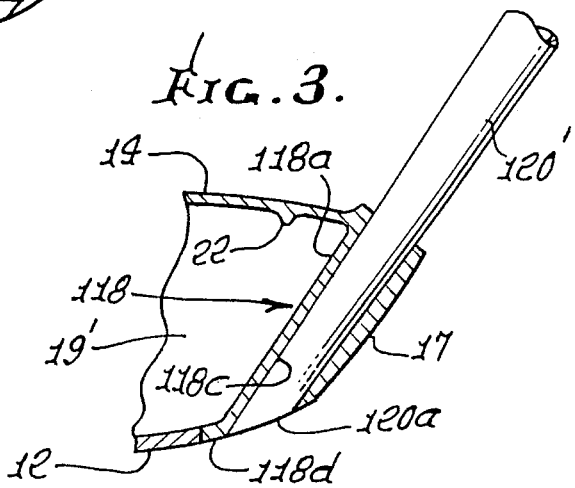
FIG. 3 is a fragmentary section taken on lines 3—3 of FIG. 1.
Figure 4B:
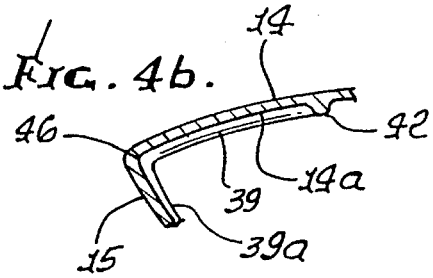
Figure 7:
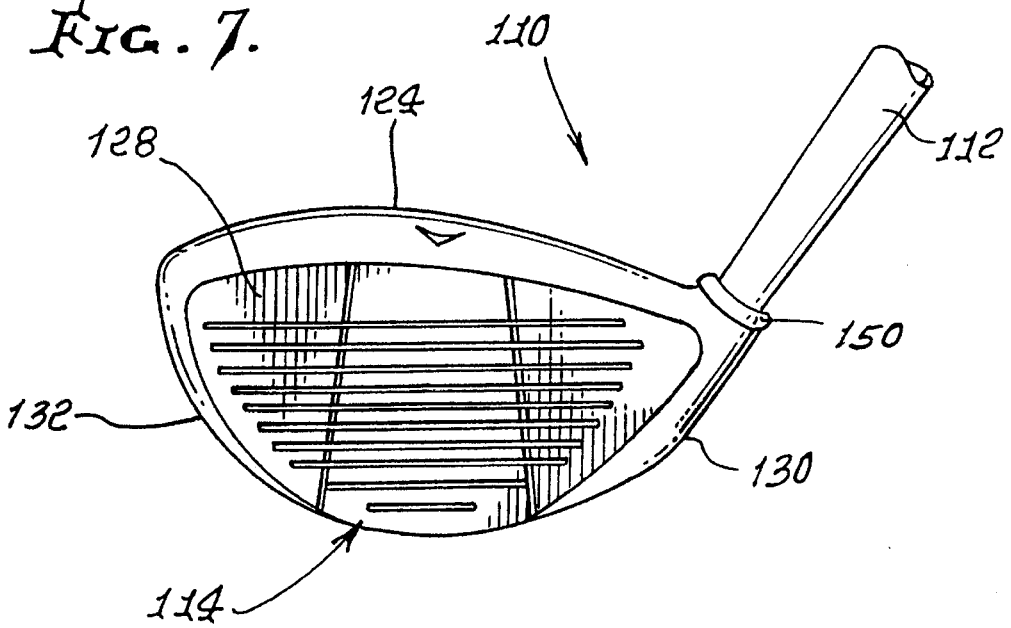
Figure 8:
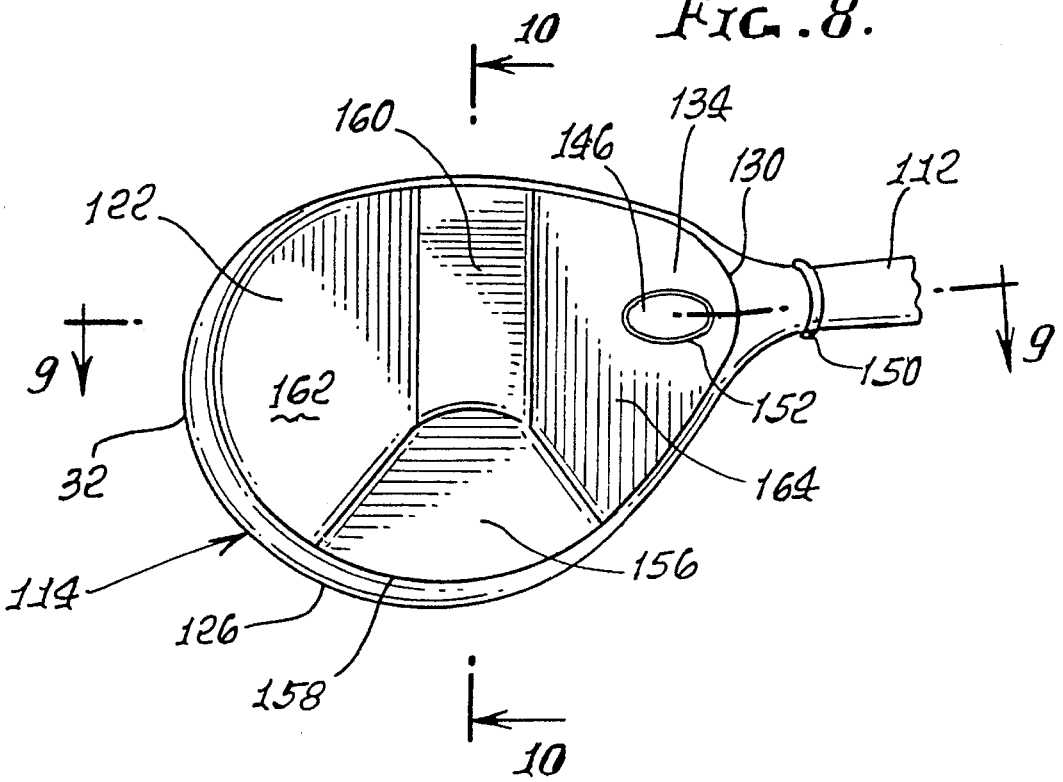
Figure 9:
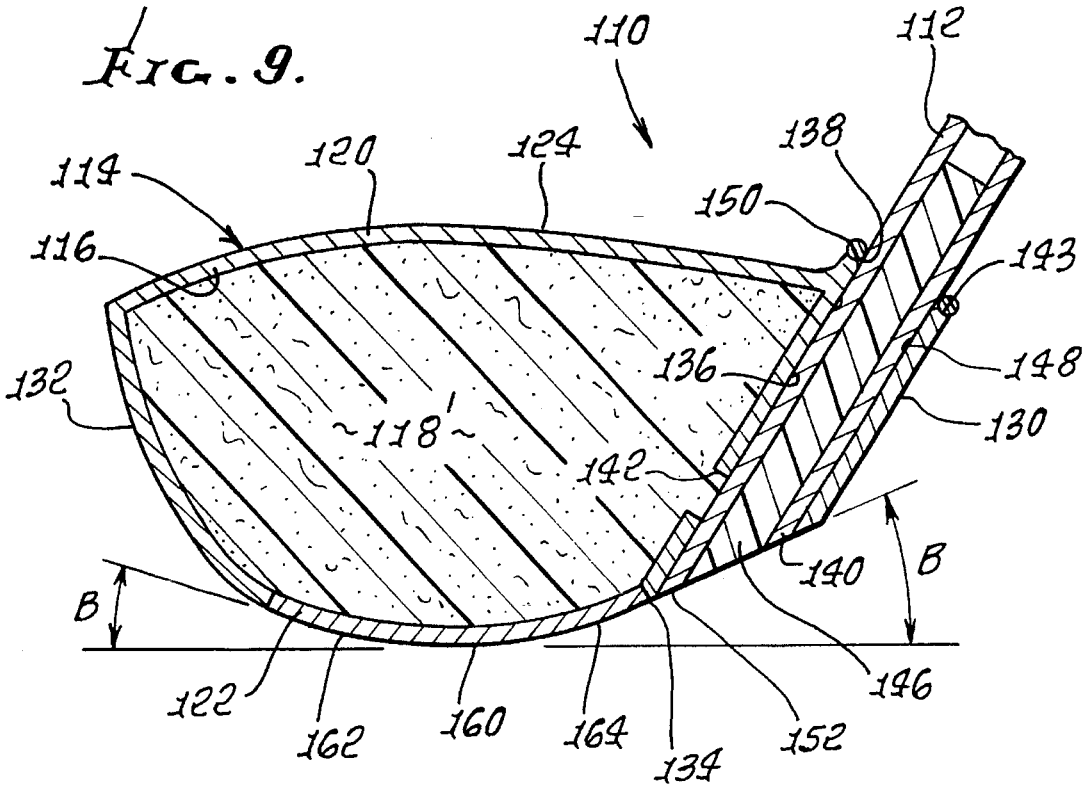
Figure 10:
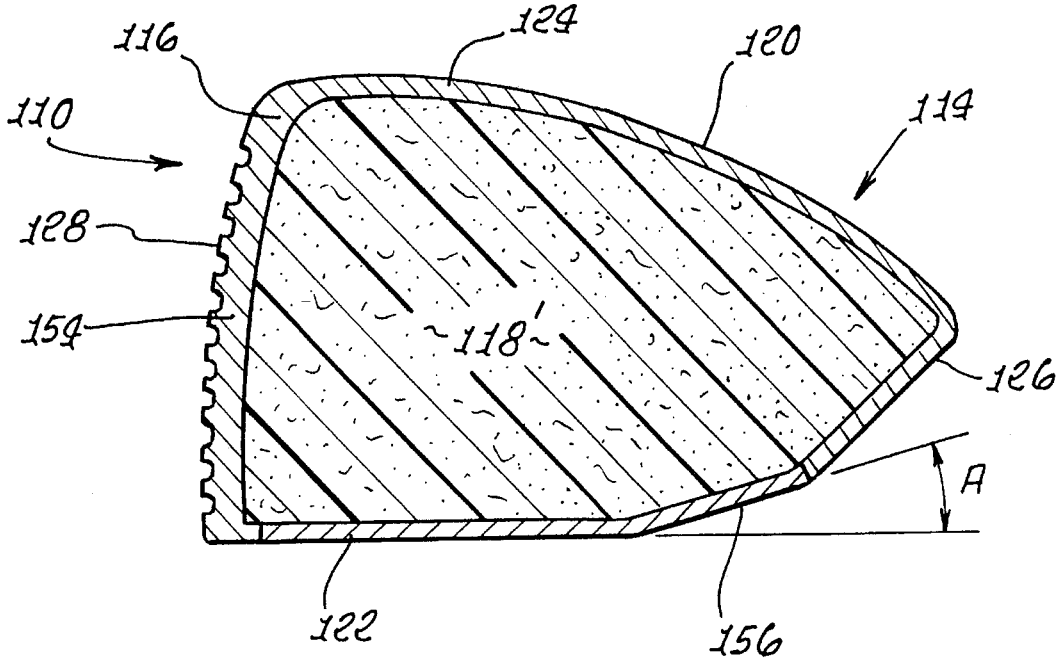
Figure 11:
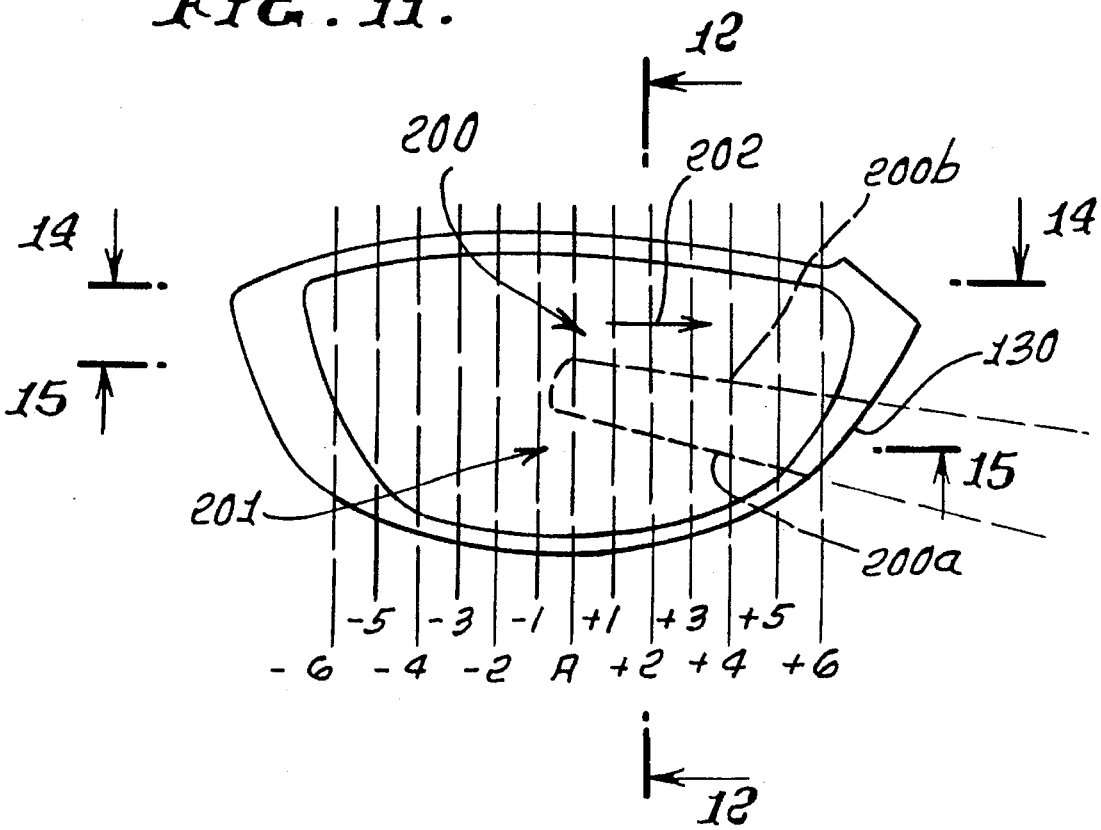
Figure 12:
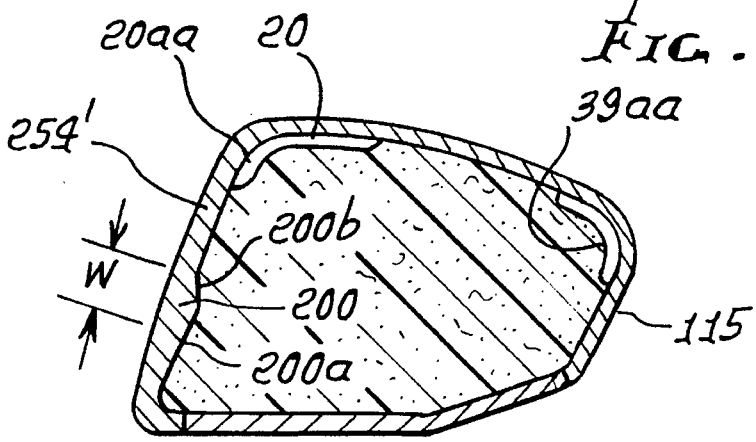
Figures 13A, 13B, 13C, 13D, 13E, 13F, 13G, 13H, 13I, 13J, 13K, 13L, 13M:
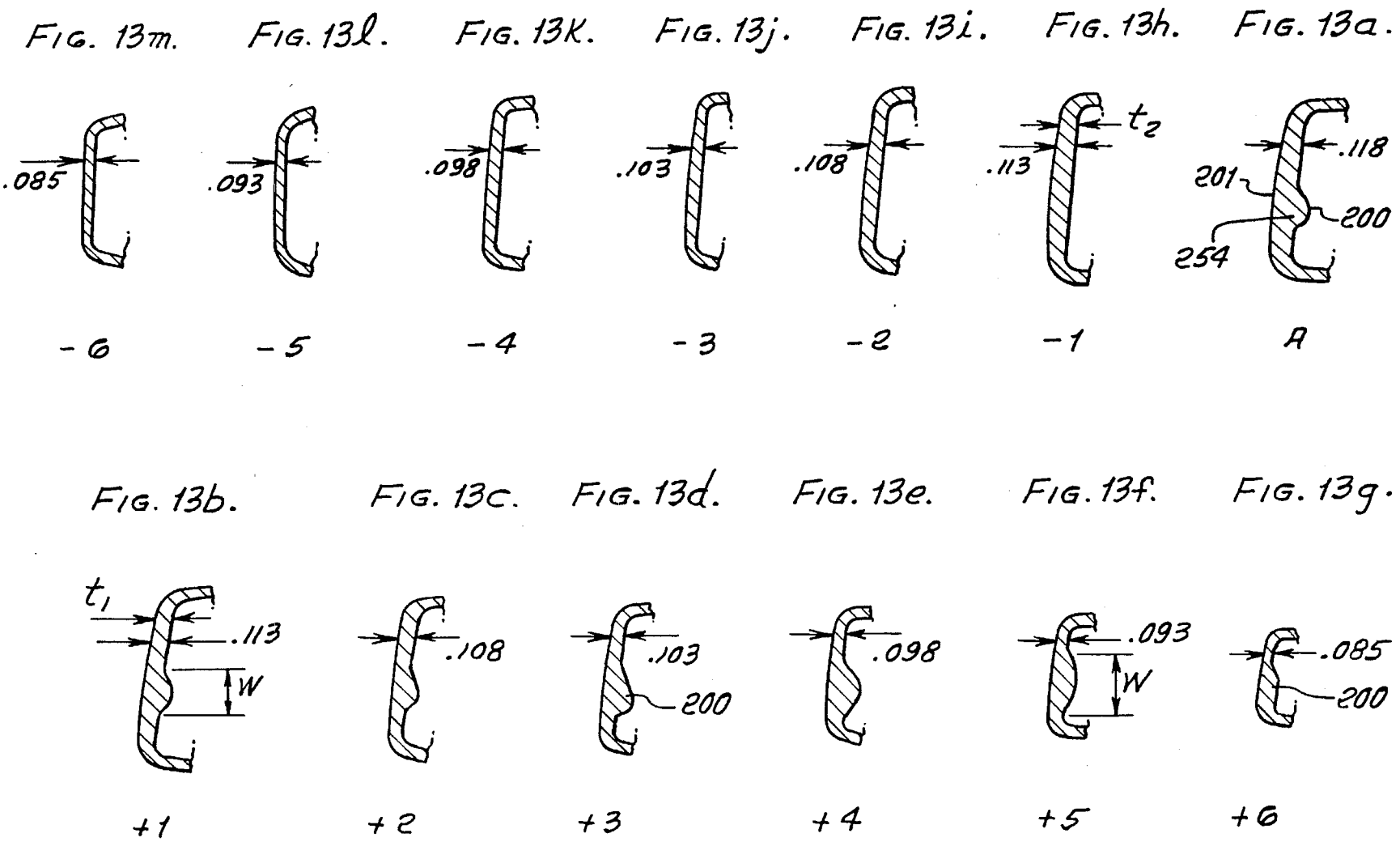

FIGS. 4*a* and 4*b* are fragmentary sections taken on lines 4*a*—4*a* and 4*b*—4*b* of FIG. 1, respectively;

FIG. 5 is a view like FIG. 1 showing a modified head construction;

FIG. 6 is an elevation looking toward the front face of the FIG. 5 head;

FIG. 6*a* is a fragmentary section taken on lines 6*a*—6*a* of FIG. 5;

FIG. 6*b* is an enlarged section taken on lines 6*b*—6*b* of FIG. 5;

FIG. 7 is a front elevational view of a metal wood golf club in accordance with a preferred embodiment of the present invention, showing the head and the lower portion of the shaft;

FIG. 8 is a bottom plan view of the golf club shown in FIG. 7;

FIG. 9 is a cross-sectional view taken along lines 9—9 of FIG. 8;

FIG. 10 is a cross-sectional view taken along lines 10—10 of FIG. 8;

FIG. 11 is a front view of a golf club head, like that of FIG. 7, and showing locations of vertical planes extending front-to-rear through the head front wall, as well as the location of a fan-shaped protrusion or thickened portion;

FIG. 12 is a section taken on lines 12—12 of FIG. 11;

FIGS. 13(*a*)–13(*m*) are enlarged partial sections corresponding to the locations of the front to rear vertical planes indicated in FIG. 11;

FIG. 14 is a horizontal section taken on lines 14—14 of FIG. 11;

FIG. 15 is a horizontal section taken on lines 15—15 of FIG. 11; and FIG. 16 is a horizontal section taken through a cast head showing the relationship between the locally thickened front wall, as per FIGS. 13(*a*)–(*m*), and a hosel tube integrated into the head interior.

DETAILED DESCRIPTION

In FIGS. 1–8, the golf club 10 comprises a head in the form of a thin metallic body 11 typically cast, and having a metallic sole plate 12. These elements may consist of steel, stainless steel, or other material, and formed by processes other than investment casting. The hollow body includes a front wall or faceplate 13 having a front surface 13*a* adapted to strike a golf ball, as well as top wall 14, rear wall 15, and toe and heel walls 16 and 17. As will be seen, the front wall or faceplate advantageously has variable thickness. A hosel 118 extends downwardly into the hollow interior 19' of the heel portion of the head and is adapted to receive a shaft 120'. Thus, the weight of the hosel is concentrated more directly behind, or close to, the rear side 13*b* of front wall 13, near the heel, to contribute to the ball-striking mass of the front wall. Also, the hosel cylindrical wall 118*a* reinforces the Junction of the variable thickness front wall, bottom wall and heel wall 17, at locus 17*a*. See also hosel webbing or filleting at 118*b*, and hosel bore 118*c* receiving shaft 120. Shaft lower end 120*a* is shown flush with the bottom surface 118*d* of the hosel.

In accordance with an important aspect of the invention, a first group or set of narrow, metallic dendrites is provided to extend from the front wall 13 generally rearwardly adjacent the underside 14*a* of the top or upper wall 14 and integral therewith. See in the example dendrites 18–22 spaced apart in a transverse direction indicated by arrows 20, the dendrites having forward ends 18*a*–22*a* merging into the front wall at its Junctions with the top wall, the dendrites extending downwardly at locations 18*aa*–21*aa* to provide variable front wall thickness. Note the possible widening of the dendrites as they merge with front wall 13 and locally vary the front wall thickness. Such variable thickness of the front wall serves the purpose of distributing impact produced shock waves from the front wall to the top wall, together with Junction 23, especially when a ball is hit high on the front wall or face. This in turn serves to prevent cracking and buckling of the thin metal wall 14. Note that the dendrites are spaced apart, i.e., branch at intervals of about ½ to ¾ inch; and that the rearward ends of the dendrites at 18*b*–22*b* are transversely spaced apart. The vertical dimension "d" of the dendrites lies within the range 0.050 to 0.100 inch; and the dendrites are generally convex at 25 toward the interior of the head, along their lengths, and have concave opposite sides at 26 and 27 (see FIG. 4). In this regard, the thickness of the front wall is typically substantially greater than the thickness of the other walls, to strengthen it and prevent cracking under high impact loads. Typical wall approximate thicknesses are: front wall about 0.105 inches at locations offset from 18*aa*–21*aa*, sole plate 0.035 inches, and top wall 0.028 inches. These dimensions are less than current state of the art standard thicknesses, allowing for a larger head and a larger moment of inertia of the head proper for a given total weight. This in turn allows a greater "forgiveness effect" as regards off-center ball strikes.

Also shown is at least one additional dendrite, as at 30, extending from the hosel wall or structure generally rearwardly and transversely, adjacent the upwardly arching underside 14*a* of the top wall and integral therewith. It is sized in cross section, the same as dendrites 18–22, all of such dendrites having about the same cross sectional dimensions. Dendrite 30 distributes impact force or shock waves from the hosel rearwardly and transversely, along its length and to the upper wall 14. Thus, shock waves are well distributed in their transfer to upper wall 14, as by the dendrites, to minimize risk of head cracking and buckling, especially along the angled junction 23.

Further, the conformation of the dendrites (see FIG. 4*a*) along their lengths, to head interior wall shape, contributes to shock wave distribution across the upper wall 14. Note that wall 14 may be upwardly crowned, i.e., upwardly shallowly convex.

Another aspect of the invention includes the provision of a second set or group of narrow, metallic dendrites extending generally rearwardly adjacent the underside of the top wall and integral therewith, the second set also including a transversely extending dendrite intersecting the generally rearwardly extending dendrites of the second set. The dendrites of the second set are located further from the head front wall than the first set of dendrites; the rearwardly extending dendrites of the second set being spaced apart, or branching, in transverse direction. The vertical dimensions of the second set dendrites also being between 0.050 and 0.100 inches. See for example the four dendrites, 38–41, that have fan configuration, radiating rearwardly from different points along the single dendrite 42 spaced rearwardly from dendrites 18–21. Dendrites 38–41 extend generally rearward to merge with the generally curved rear wall 15 of the head, to direct or transfer such rearward loading to that wall as the dendrites pick up loading from top wall 14. Such rear dendrites provide the rear wall with varying thickness along its toe-to-heel rearward dimensions. Dendrites 38–42 have generally the same configuration and dimensions as dendrites 18–22 and 30. Accordingly, they serve the same shock wave transfer distributing functions to minimize cracking and buckling of the thinned top wall at its junction at 46 with the rear wall. Note also that dendrites 38–42 conform to top wall shape along their lengths. See FIG. 4*b*. In addition, the rearward ends of the dendrites 38–41 turn downwardly adjacent the inner side of wall 15, as seen at 39*a* in FIG. 4*b*, for example.

In FIG. 5, the head itself is the same as in FIGS. 1–4 and the same identifying members are used. Forward dendrites 48–51 correspond to dendrites 18–22, but their transverse spacing "s" is greater, being about ¾ inch to 1 inch. See spacings $s_1$ and $s_2$. Dendrites 48–51 have the same cross-sectional dimensions, and a generally convex-concave surface configuration, as do dendrites 18–22. Dendrite 53 corresponds to dendrite 30 in FIG. 1. All dendrites may, for example, have maximum height dimensions (below the top wall) of about 0.060 inches.

The five rearward dendrites 68–72 extend or fan rearwardly from a transverse dendrite 73, that corresponds to dendrite 42 in FIG. 1; and they intersect the rearward wall 15 of the head, at intersections along the junction line 76.

Dendrites 48–51 transfer loading from the front wall 13 to the top wall 14; and dendrites 68–72 transfer shock waves from the top wall to the rear wall 15. Dendrite 73 assists this function. Dendrite 53 transfers shock waves from the hosel to the top wall 14.

The number and position of dendrites may vary according to the various head sizes and shapes.

The fact that the dendrites enable head wall thinning allows use of heavier density metallic compositions in the head walls, without reducing the head size below the sizes of standard hollow metal heads made of steel. For example, compositions such as beryllium copper, tungsten, surgical steel alloys, and cobalt alloys can be used. In the past, such heavier metal compositions could not be used without reducing head size.

The provision for variable thickness of the front wall, to strengthen the front wall and its zone of merger with the top wall, together with dendrite strengthening of the rear wall, as by provision of rearwardly and downwardly extending dendrites (as in FIG. 4*b* for example) provide a double-strengthened head effect, allowing for yet further thinning of other walls, and yet greater enlargement of the overall head.

Referring now to FIGS. 7–10, a golf club 110 includes a shaft 112 (only the lower portion of which is shown), which is attached to a head 114. The head 114 is in the configuration of a "wood" club, although it is made of metal. As shown in FIGS. 9 and 10, the head comprises a hollow metal shell 116, which is filled with a plastic foam filling 118', preferably polyurethane.

The shell 116 is preferably made of stainless steel, and it may be fabricated by the "lost wax" casting method that is well-known in the art. The shell 116 is formed in two pieces: a main portion 120, and a sole plate 122 that is welded to the main portion 120.

The main shell portion 120 has a top surface 124, a rear surface 126, and a striking surface or face 128 opposite the rear surface 126. The face 128 is angled with respect to the vertical with a specified "pitch" that is determined by the type of club and the amount of loft desired. The end portion of the head 114 proximate the shaft 112 is commonly termed the "heel" 130, while the end portion opposite the heel 130 is termed the "toe" 132. As shown in FIG. 8, the face 128 is typically curved from the heel 130 to the toe 132. The main shell portion 120 has a bottom corner portion 134 (shown in cross-section in FIG. 9) that is flush with the sole plate 122, and that forms a bottom surface or sole in combination with the sole plate 122 when the two shell portions are welded together.

Referring now to FIG. 9, the heel portion 130 of the shell 116 is provided with a substantially continuous hollow tube 136 that extends from an upper opening 138 in the top surface 124 to a lower opening 140 in the bottom surface or sole through the bottom corner portion 134 of the main shell portion 120. The tube 136 is of substantially uniform internal diameter, and its side wall is interrupted by an internal orifice 142 that opens into the interior of the shell. The orifice 142 provides an entrance for the introduction of the foam material 118 into the shell interior during the manufacturing process.

The tube 136 is dimensioned to receive the lower part of the shaft 112 with a snug fit. The upper opening 138 is provided with a radiused lip 143, as shown in FIG. 9, to minimize the possibility of stress fractures in the shaft due to impact against the edge of the opening. A portion of the interior wall of the tube 136, extending downwardly from the upper opening 138, is configured to provide a "glue lock" for better bonding of the shaft in the tube, as will be described below. The lip 143 is at the end of a slight rise at the heel end of the head, the height of the rise being less than, or approximately equal to, the height of a horizontal plane defined by the highest point of the club head top surface 124.

The shaft 112 is a hollow tube made of any suitable material. Steel is the most common material, but titanium and graphite-boron may also be used. If the shaft is of stainless steel, the exterior of the shaft may be chrome-plated to minimize corrosion. The lower part of the shaft is fitted with a plug 146 to prevent the entry of moisture into the interior of the shaft. The plug 146 may be of any suitable resilient material, such as Nylon, epoxy, polyurethane, or Delrin. The plug 146 may be retained in the shaft by an annular crimp 148 in the shaft wall. The crimp 148 also serves as a glue lock, as will be discussed below. A locator ring 150, for example of glass fiber-reinforced Nylon, is adhesively bonded to the shaft at a distance above the bottom end 152 of the shaft approximately equal to the maximum length of the tube 136.

The shaft 112 may be attached to the head 114 by a suitable epoxy adhesive, "glue locks", as mentioned above, being provided for better adhesive bonding. (Any plating on the lower part of the shaft is first buffed off.) During assembly, the lower part of the shaft is inserted into the tube 136 until the locator ring 150 abuts against the radiused lip 143 at the upper tube opening 138. The bottom end 152 of the shaft 112 then extends slightly beyond the lower tube opening 140. This bottom end 152 is then cut and ground so as to be flush with the sole of the head, as shown in FIGS. 8 and 9.

The structure described above allows the shaft to be attached to the head without a neck or hosel. As a result, substantially all of the mass of the head is "effective mass" that contributes to the transfer of energy from the player to the ball, with little or no "deadweight" to reduce the attainable club head velocity. By increasing the effective mass of the club head without reducing the attainable velocity, there is a more effective transfer of energy to the ball from the player, yielding increased shot distance without an increase in effort on the part of the player.

Moreover, without a hosel, the lower part of the shaft extends all the way through the head, with the bottom end 152 of the shaft terminating flush with the sole. Thus, by eliminating the hosel, the shaft both enters and exits the head within the area defined between the top and bottom of the face of the club head, which area is sometimes called the "ball control zone". By bringing the lower end of the shaft within the ball control zone and extending the shaft through to the sole of the club head, the tactile sense of the location of the club face, or "head feel", is maximized, yielding increased control of the shot, greater ability of the skilled player to "work" the ball, and a more solid feel of impact with the ball regardless of where on the face the ball is struck. The increase in effective mass of the club head, plus the rigid support for the lower end of the shaft provided by the internal tube 136 in which the lower end of the shaft is received, further contribute to this improvement in "head feel".

Furthermore, a number of advantages in the manufacturing process can be achieved by eliminating the hosel. For example, the mass that would have been taken up by the hosel can be redistributed to a part of the club head where it can contribute to the effective mass and movement of intertia of the head without increasing the total head mass.

Still another advantage of eliminating the external hosel is that there is a more even cooling of the club head in the mold. Where there is an external hosel, by comparison, the hosel and the rest of the club head shell may cool at unequal rates, thereby resulting in a slight warping that can produce a lack of uniformity in loft, lie, and face angle from club head to club head.

The sole configuration includes a trailing edge, flat 156, which is a relieved, upwardly-angled flattened portion extending upwardly from a point approximately midway between the center of the sole and a trailing edge 158 at the Juncture between the rear surface 126 of the club head and the sole plate 122. The lowermost part of the trailing edge flat 156 is contiguous with the interior end of a rounded rail 160 that extends forward to the bottom edge of the face 128 of the club head. Extending upwardly from one side of the rail 160 to the toe end 132 of the club head is a second relieved and flattened portion of the sole that may be termed a toe flat 162. Similarly, extending upwardly from the other side of the rail 160 to the heel end 130 of the club head is a third relieved and flattened portion that may be termed a heel flat 164.

The trailing edge flat 156 is preferably at an angle A of approximately 18' with respect to the horizontal, while the toe flat 162 and the heel flat 164 are preferably at an angle B of approximately 19° with respect to the horizontal. The angles A and B may be varied by plus or minus up to 5°, depending on the type of club and the preference of the player.

The purpose of the three flats—156, 162 and 164—and of the rail 160 is as follows: the rail 160 guides the club head in a straight line through impact with the ball, even if the ball is hit slightly "fat", or is hit out of the rough or sand. The trailing edge flat 156 minimizes the club head's closing, or "hooding", when the ball is hit fat, while reducing the overall aerodynamic drag of the club head to maximize its attainable velocity during the swing. The toe flat 162 and the heel flat 164 facilitate shots from sidehill and uneven lies.

From the foregoing description, it will be appreciated that a golf club head, in accordance with the present invention, offers a number of significant advantages over prior art "metal woods". For example, the effective club head mass is increased to nearly 100 percent of the total club head mass, thereby maximizing the efficiency of energy transfer from the player to the ball. By maximizing the effective club head mass, and by bringing the lower end of the shaft down through the entire club head and into the sole through an internal tube in the club head, "head feel" is dramatically increased to the point where it is comparable to that attainable with high quality persimmon woods. Greater uniformity in club head shape can be achieved by reducing warpage in the mold from unequal cooling of the hosel as compared to the rest of the shell. The shape of the sole helps to increase shot accuracy from uneven lies, the rough, and sand traps, while minimizing the deleterious effects on shot accuracy resulting from hitting the ball fat, and while also providing excellent aerodynamic qualities for the club head to maximize attainable club head velocity during the swing.

Referring now to FIGS. 11–13, it will be noted that the front wall 254 of the cast metallic head has locally varying thickness. It includes a locally rearwardly thickened portion 200 which extends in a direction from a mid-region 201 of the front wall, toward a peripheral region of the head, near the heel 130. Thickened portion 200 projects throughout its elongated length toward the interior of the head, as is seen from both FIG. 12 and the sections (*a*)–(*g*) of FIG. 13. Note also that the thickened portion 200 has upright width "w" which progressively increases in the direction designated by the arrow 202 in FIG. 11. The thickened portion is rearwardly generally dome-shaped in upright planes which extend rearwardly, as for example are represented by sections 13(*b*)–13(*f*), and as viewed in FIG. 12. The thickened portion 200 has fan-shaped divergence or flare between the mid-region 201 of the front wall and the heel 130 of the head, and at the rear side of front wall 254. Note that the bottom edge region 200*a* of the thickened portion 200 is concave rearwardly in FIG. 12, and slopes downwardly and rightwardly in FIG. 11, as is also clear from FIGS. 13(*a*)–13(*g*). The upper edge region 200*b* of the thickened portion 200 is rearwardly and upwardly concave in FIG. 12, and remains at about the same level in direction 202 in FIG. 11.

The thickened region facilitates flow of hot metal during casting, into the space 200' seen in FIG. 15 between mold sections 210 and 211, and as indicated by arrow 212, from a metal supply gate 213, necked at region 213*a*, with minimum cooling. This, then, facilitates flow of metal to the entire variable thickness front wall 254, and to the reduced thickness top, rear, toe, and heel walls, without such metal cooling and thickening as would prevent or impede metal flow to the entireties of the head shell walls.

A further feature is the provision of front wall decreasing (varying) thickness $t_1$, in a direction from the mid-region 201 toward the heel, and at locations offset from the locally thickened portions 200'. See FIGS. 13(*a*)–13(*g*) in this regard. Representative thicknesses $t_1$ in inches are indicated, but these can vary. Similarly, the front wall has decreasing (varying) thickness $t_2$ in a direction from the mid-region 201 toward the toe of the head, as seen at sections 13(*a*)–13(*m*). Again, representative thicknesses are indicated, but these can vary. Such head front wall thickness tapers toward both the heel and toe, and provides for maximum strength near the ball striking mid-region or sweet-spot 201 of the front wall, in a head wherein the other walls (top, rear, heel, and toe) are of relatively reduced thickness. Strengthening of the front wall is additionally increased by the thickened portion 200 described. Representative wall thicknesses are as follows:

| wall | thickness size, in inches |
|---|---|
| top | .028–.035 |
| rear | .028–.035 |
| heel | .028–.035 |
| toe | .028–.035 |

FIG. 16 illustrates the relative positions of the fan-shaped locally thickened portion 200 and the internal hosel tube 136, as seen in a head of FIGS. 7–11 type. Note that the thickened portion 200 merges with that hosel, along its length, and locally of the forward extent of the hosel tube. Added strengthening of the head results, as well as assured flow of hot metal, during casting, from the gate to the hosel spaces provided in the mold.

Note also in FIG. 16 the forward dendrites 18–22, with forward portions 18*aa*–21*aa* (as referred to above) merging with the front wall and contributing to variable wall thickness, as referred to in the discussion of FIGS. 1–6. See also rear dendrites 39'–41'.

FIG. 12 shows the forward dendrite portions, as at 20*aa*, extending well downwardly adjacent the rear side of the variable thickness front wall 254' to buttress and strengthen that wall; and also the rear dendrites extending downwardly as at 39*aa* adjacent rear wall 115, to strengthen same and provide the rear wall with variable thickness along its length. Accordingly, a dual-strengthening (front and rear of the head) effect is thereby significantly achieved.

We claim:

1. A golf club head having a heel, a toe and a front wall, and comprising:

a) said front wall having variable thickness between the heel and toe, b) said front wall additionally having a locally rearwardly thickened and bulging portion extending toward the heel from a mid-region of the front wall, c) there being a hosel tube defining a cylinder projected proximate the heel, said tube projecting within the head and integrated with the heel, d) said front wall having decreasing thickness in a direction generally toward the front side of said projected cylinder, within the head.

2. A metallic golf club head having a hollow interior, comprising a) a ball-striking front wall, and the head having walls at the top, bottom, rear, heel, and toe of the head, said head having a shaft receiving tube interiorly of the head and proximate the heel, the shaft connected to the tube, b) said front wall having variable thickness in regions between the heel and toe to transmit golf striking impact forces from the head front wall to said top wall without cracking or buckling of said front wall or top wall, c) said front wall also having an additional locally rearwardly thickened and bulging portion which extends in a direction toward the heel from a mid-region of the front wall, d) said tube defining a cylinder projecting proximate the heel, e) said varible thickness decreasing in a direction generally toward the front side of said cylinder.

3. The head of claim 2 wherein said variable thickness is measured in vertical planes normal to said front wall and spaced apart between said toe and heel.

4. The head of claim 2 wherein said thickness also locally decreases from a mid-region of said front wall in a direction toward said toe.

5. The head of claim 2 wherein said thickness also decreases locally from a mid-region of said front wall in a direction toward said heel.

6. The head of claim 1 wherein said hosel tube is integral with the head and located within the interior thereof and proximate said variable thickness front wall.

7. The head of claim 2 wherein said variable thickness exists at locations proximate a merging interconnection of said front wall and said top wall.

8. The head of claim 2 including c) a first group of narrow, metallic, shock wave distributing dendrites extending from proximate said variable thickness front wall generally rearwardly adjacent the underside of the top wall and integral therewith, d) the dendrites spaced apart by amounts greater than their widths.

9. The head of claim 6 wherein the dendrites, hosel tube within the head interior, and said variable thickness front wall all comprise part of a single metallic casting.

10. The head of claim 8 wherein the front wall also has local thickness substantially greater than the thickness of the top wall, and said dendrites of the first group merge with the inner side of said variable thickness front wall.

11. The head of claim 2 including a group of narrow metallic dendrites which are integral with said rear wall and extend downwardly at the inner side of said rear wall.

12. The head of claim 8 including a second group of narrow metallic dendrites which are integral with said rear wall and extend downwardly at the inner side of said rear wall.

13. The head of claim 12 wherein the dendrites of the second group are located further from the front wall than the dendrites of the first group.

14. A metallic golf club head having a hollow interior, comprising a) a ball-striking front wall, and the head having walls at the top, bottom, rear, heel, and toe of the head, said head having a shaft receiving tube interiorly of the head and proximate the heel, b) said front wall having variable thickness between the heel and toe to transmit ball striking impact forces from the head front wall to said top wall without cracking or buckling of said front wall or top wall, c) said variable thickness in upper regions of said front wall decreasing from an upper mid-region in a direction toward said toe and from said upper mid-region in a direction toward said heel and directly forwardly of said tube, said upper mid-region being defined by an upper region of said front wall about mid-way between the toe and heel, d) said tube integral with the head and located within the interior thereof proximate said heel wall and proximate said variable thickness front wall and said variable thickness existing at locations proximate a merging connection of said front wall and said top wall, e) said variable thickness decreasing in a direction generally toward the front side of said tube.

15. The head of claim 2 wherein said front wall has substantially minimum thickness proximate the toe.

16. The head of claim 2 wherein said front wall has substantially minimum thickness proximate the heel.

17. The head of claim 2 wherein the front wall locally rearwardly thickened portion extends toward a peripheral region of the front wall.

18. A metallic golf club head having a hollow interior and comprising a) a ball-striking, upright front wall, and the head having walls at the top, bottom, rear, heel, and toe of the head, b) there being a hosel tube which is within the head and proximate the heel, and said front wall having a locally rearwardly thickened portion extending closely toward the tube, c) said front wall also having variable thickness between the heel and toe, said variable thickness decreasing in a direction toward the heel and toward the forward side of said hosel tube, d) said hosel tube integrated with the head, which supports the tube along its length and at said heel wall.

19. The head of claim 18 wherein said front wall has a locally thickened portion that projects into the hollow interior of the head.

20. In a golf club, of the type including a head and a shaft with a first end, a portion of the shaft proximate said first end being attached to a head, the head comprising a hollow metal shell having a ball striking front wall having a striking surface, a top wall portion, a bottom portion, a toe portion, and a heel wall furthest from said toe portion, said top wall portion being substantially continuous from said toe portion to said heel portion, the improvement comprising:

a) a substantially continuous hollow, metallic tube extending lengthwise along a shell wall from the shell top portion toward the shell bottom portion, said tube being integral with and terminating proximate said metal shell top portion and having a bore, b) the tube bore receiving said shaft portion, c) the shaft periphery, connected to the tube bore, and the tube bore having an upper end terminating proximate said shell top portion, d) the tube integrated with said shell wall so that the shell supports the tube along its length, and at said heel portion, and whereby metal otherwise required for the tube is used in the shell at locations between the tube and said toe portion, e) said front wall having variable thickness between the heel portion and the toe portion, said variable thickness decreasing in a direction toward the toe and in a direction toward the heel, and generally toward the forward side of said tube.

21. The head of claim 18 wherein said front wall has a locally thickened portion having upright width which progressively increases toward the periphery of the front wall near the heel.

22. The head of claim 19 wherein said thickened portion is rearwardly generally dome-shaped in upright planes which extend rearwardly.

23. The head of claim 18 wherein said front wall has decreasing thickness in a direction from said mid-region toward said toe.

24. The head of claim 18 wherein said front wall has decreasing thickness in a direction from said mid-region toward said heel, and at locations offset from said locally thickened portion.

25. The head of claim 23 wherein said front wall has decreasing thickness in a direction from said mid-region toward said heel, and at locations offset from said locally thickened portion.

26. The head of claim 18 wherein said mid-region of the front wall is near the center of the front wall and at the rear side thereof.

27. The head of claim 18 wherein said mid-region is about half way between the toe and heel, and about half way between the top and bottom walls of the head.

28. In a golf club, of the type including a head and a shaft with a first end, a portion of the shaft proximate said first end being attached to a head, the head comprising a hollow metal shell having a ball striking front wall having a striking surface, a top wall, a bottom wall, a toe portion, and a heel portion furthest from said toe portion, the improvement comprising:

a) a substantially continuous hollow, metallic, hosel tube extending within said metal shell at the heel portion from the shell top wall toward the shell bottom wall, said tube being integral with and terminating proximate said metal shell top wall, and having a bore, said heel portion including a heel wall merged with a rearwardmost extent of said tube, b) the tube bore receiving a portion of the first end of the shaft, and there being means connecting the shaft periphery to the tube bore, c) said front wall having variable thickness between said toe portion and said heel portion, said variable thickness decreasing in a direction toward the toe, and in a direction toward the heel and toward the forward side of said tube.

29. A method of attaching a metal golf club head to a shaft, comprising the steps of:

a) providing metal golf club head with a top surface, a bottom surface, a front wall having a ball-striking surface with an uppermost extent, a rear surface, a heel portion, a toe portion, and a substantially continuous hollow tube extending between the top surface and the bottom surface near the heel portion, said tube being formed to have an upper end terminating proximate the level of said uppermost extent of said striking surface, and proximate an uppermost extent of said heel end, b) forming said front wall to have variable thickness between said toe portion and said heel portion proximate said tube, c) and inserting the lower end of the shaft into the tube with an adhesive material applied between the exterior surface of the shaft and the interior wall of the tube, the shaft being inserted so that the lower end of the shaft extends proximate said bottom surface, d) said front wall variable thickness also provided to decrease in a direction toward said tube.

30. The method of claim 29 including forming said front wall to have a locally thickened portion that extends from a mid-region of the front wall generally toward the front wall periphery.

31. The method of claim 30 including connecting said tube with said locally thickened portion of the front wall.

32. The improvement of claim 18 wherein said locally thickened portion flares generally toward said tube.

33. The improvement of claim 18 wherein said locally thickened portion is rearwardly generally dome-shaped in upright planes which extend rearwardly.

34. The improvement of claim 18 wherein said front wall has decreasing thickness in a direction from a front wall mid-region toward said toe portion.

35. The improvement of claim 34 wherein said front wall has decreasing thickness in a direction from a front wall mid-region toward said heel portion.

36. The improvement of claim 34 wherein said front wall has decreasing thickness in a direction from said mid-region toward said heel portion.

* * * * *